US005414878A

United States Patent [19]

Booth

[11] Patent Number: 5,414,878

[45] Date of Patent: May 16, 1995

[54] SANITARY WHIRLPOOL JET APPARATUS

[75] Inventor: John W. Booth, Irving, Tex.

[73] Assignee: SaniJet Corporation, Dallas, Tex.

[21] Appl. No.: 147,201

[22] Filed: Nov. 3, 1993

[51] Int. Cl.[6] ..... A61H 33/02

[52] U.S. Cl. ..... 4/541.6; 74/665 F; 74/665 GB; 417/423.1

[58] Field of Search ..... 4/541.1–541.6, 4/492; 417/423.1, 423.5, 423.6; 74/665 F, 665 GB

[56] References Cited

U.S. PATENT DOCUMENTS

| | | | |
|---|---|---|---|
| 2,733,711 | 2/1956 | Gibson . | |
| 3,112,728 | 12/1963 | Krause | 74/665 GB X |
| 3,302,640 | 2/1967 | Jacuzzi . | |
| 3,304,936 | 2/1967 | Kosta . | |
| 3,391,870 | 7/1968 | Nash | 239/417.3 |
| 3,452,370 | 7/1969 | Jacuzzi . | |
| 4,256,277 | 3/1981 | Embree | 74/665 F X |
| 4,853,987 | 8/1989 | Jaworski | 4/542 |
| 5,063,620 | 11/1991 | Mersmann | 4/542 |

FOREIGN PATENT DOCUMENTS

| | | | |
|---|---|---|---|
| 0417338 | 3/1991 | European Pat. Off. | 4/492 |

OTHER PUBLICATIONS

"Bacterial Hazards in Whirlpool Baths," The ASHI Technical Journal, vol. 3, No. 1, Spring 1993, pp. 42–46.

*Primary Examiner*—Charles E. Phillips
*Attorney, Agent, or Firm*—Fulbright & Jaworski

[57] ABSTRACT

A sanitary, cleanable, whirlpool jet apparatus having means for circulating water within a whirlpool without routing the whirlpool water through circulation piping.

11 Claims, 5 Drawing Sheets .

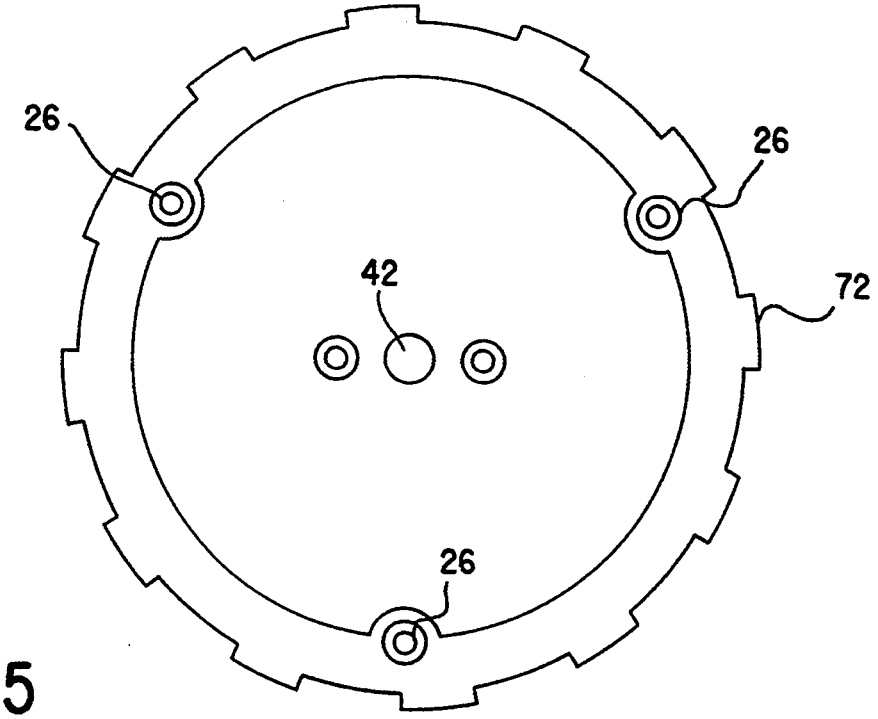
FIG.5
FIG.6
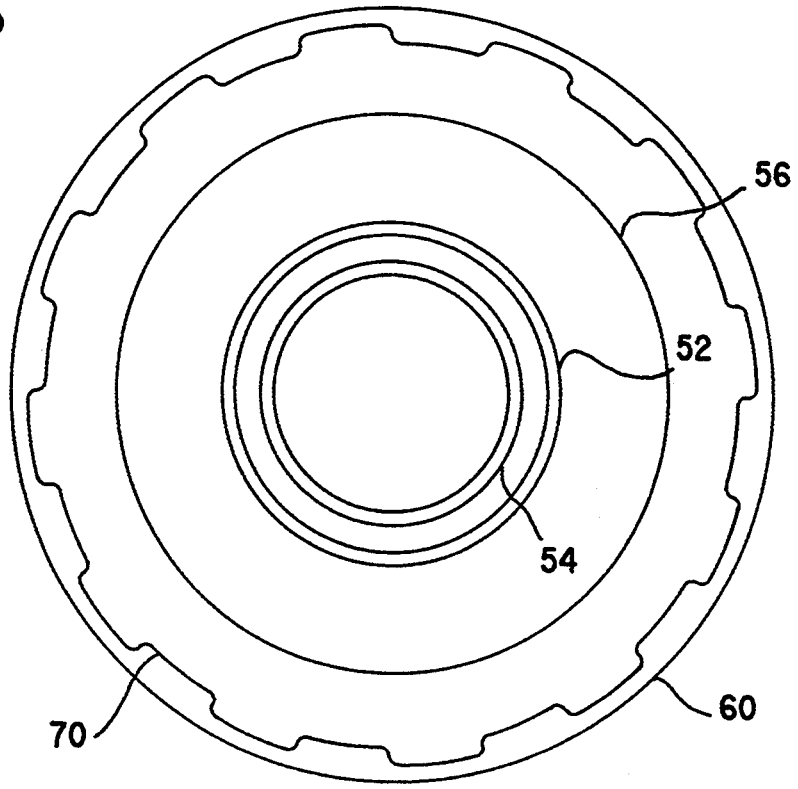

SANITARY WHIRLPOOL JET APPARATUS

BACKGROUND OF THE INVENTION

The invention is in the field of whirlpool bathtub jet apparatus.

Millions of whirlpool baths have been sold over the past thirty years and millions more will be installed in the near future. Whirlpool baths are used for recreational and medicinal purposes in homes, rehabilitation centers, and hospitals.

Conventional whirlpool baths pump water from the interior of the bathtub through generally inaccessible piping located on the outside of the bathtub. The water passing through the piping is forced back into the interior of the bathtub through nozzles on the interior sides of the bathtub.

A major shortcoming of conventional whirlpool baths is the problem of complete drainage from the exterior piping of unsanitary bath residue, including soap scum, scale deposits, body oils and other body fluids, and fecal matter. Whirlpool bathtub piping is dark, warm, and moist, thus making it an excellent breeding ground for bacteria and fungi found in bath residue. There is considerable medical evidence linking whirlpool piping systems to infections in humans. See, e.g., "Characteristics of Pseudomonas Aeruginosa Isolated from Whirlpools and Bathers," Highsmith et al., Infection Control, 1985 Vol. 6 No. 10, pp. 407–412; "Fungi in Bathwater and Sludge of Bathroom Drain Pipes," Nishimura et al., Mycopathologia 97, 1987, pp. 17–23; "Hot Tub-Associated Dermatitis due to PA, Case Report and Review of the Literature," Chandrasekar et al., Archives of Dermatology, Vol. 120, Oct. 1984; "PA Infection is Associated with Hot Tubs and Other Environments," Gregory et al., New Challenges From Infectious Diseases, 081-5520/87 pp. 638–648; "Hot Tub Folliculitis," Jenkerson et al., Alaska Medicine, April-June 1987, pp. 51–53. Some of the foregoing whirlpool infections are deadly. For example, the reported overall mortality rate of PA pneumonia is approximately 70%.

To mitigate against the dangers of whirlpool infections, many manufactures recommend that the whirlpools be regularly drained and cleaned. However, no conventional whirlpool bathtub circulation system can be fully drained, and research has demonstrated that such circulations systems can be cleaned only with the use of expensive specialized equipment that will heat, convey, and concentrate special cleaning solutions through the bathtub piping. "Bacterial Hazards in Whirlpool Baths," Guimond, The ASHI Technical Journal, Spring 1993, p. 45. No cleaning solution can be adequately circulated through such piping simply by adding it to the bathtub and activating the whirlpool bathtub pump. Id. at 44.

SUMMARY OF THE INVENTION

It is an object of the present invention to provide a removable, cleanable, sanitary whirlpool jet apparatus. It is a further object of the present invention to clean whirlpools without specialized equipment. It is a further object of the present invention to reduce bacterial and fungal infections caused by conventional whirlpools. It is a further object of the present invention to readily and easily clean 100% of all wetted surfaces of a whirlpool bathtub circulation system, thus eliminating the opportunity for bacteria growth within the apparatus and the chance of cross-infection between bathers. It is a further object of the present invention to provide a removable jet apparatus that can be removed and cleaned without breaking a waterproof seal.

To achieve the foregoing objects, there is disclosed a removable, cleanable, sanitary whirlpool jet apparatus comprising a removable and disassemblable jet assembly comprising internal means for receiving and pumping water within the interior of a whirlpool bathtub having an interior and an exterior, means for removably engaging the jet assembly within the interior of the whirlpool bathtub, and means for driving the jet assembly. The driving means of the foregoing apparatus may engage the jet assembly through a hole through the interior of the whirlpool bathtub and sealingly and rotatably communicate with the hole. The foregoing apparatus may also comprise a jet casing. The driving means may be mechanical and may comprise a flexible drive shaft attached to a motor.

Also to achieve the foregoing objects there is provided a whirlpool bathtub comprising a bathtub having a port for receiving a jet assembly, a disassemblable jet assembly removably engaged within the port, the jet assembly having means for receiving and pumping water, and means for driving the jet assembly. The driving means of the foregoing apparatus may engage the jet assembly through a hole through the interior of the whirlpool bathtub and sealingly and rotatably communicate with the hole. The driving means may be mechanical. The foregoing apparatus may also have a plurality of ports, a plurality of jet assemblies, a plurality of flexible shafts, and a plurality of holes, and the plurality of shafts may be in communication with the motor.

BRIEF DESCRIPTION OF THE DRAWINGS

FIG. 5 is a front view of the jet casing of FIG. 3.

FIG. 6 is a back view of the jet apparatus of FIGS. 4A and 4B.

DETAILED DESCRIPTION OF THE INVENTION AND PREFERRED EMBODIMENT

Figure 1A:
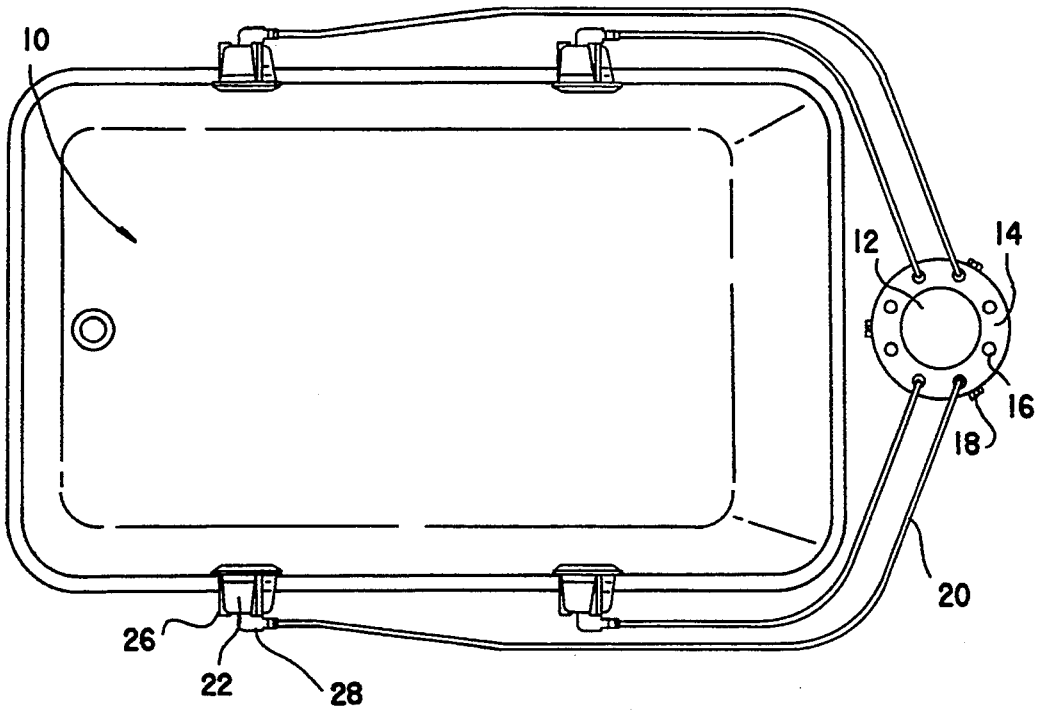
FIG. 1A is an elevational view of a typical embodiment of a whirlpool bathtub embodying the claimed invention.
Figure 1B:
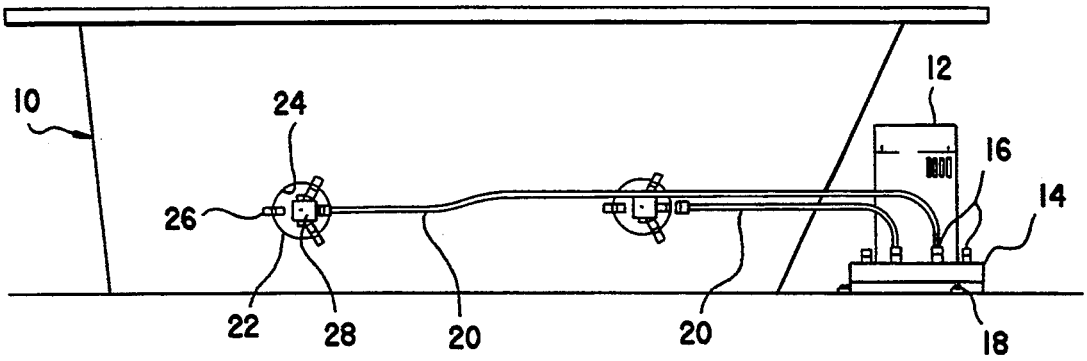
FIG. 1B is a side view of the whirlpool bathtub of FIG. 1A.

FIGS. 1 and 2 depict elevational and side views of a whirlpool bathtub 10 employing the claimed invention. Bathtub 10 is accompanied by a motor 12 attached to a gearbox 14. The gearbox 14 has drive outputs 16 and is mounted by mounted flanges 18. The drive outputs 16 are connected to flexible drive shafts 20.

The bathtub 10 has jet casings 22 for mounting into the holes 24 of the wall of the bathtub 10. The jet casings 22 are securely fastened within the holes 24 by J-latch assemblies 26 or other fastening means. A gasket or other sealing means is used to provide a water-tight seal between the bathtub 10 and the jet casings 22. Gear housings 28 are permanently attached to the backside of each of the jet casings 22. The gear housings 28 are connected to the flexible drive shafts 20.

Figure 2A:
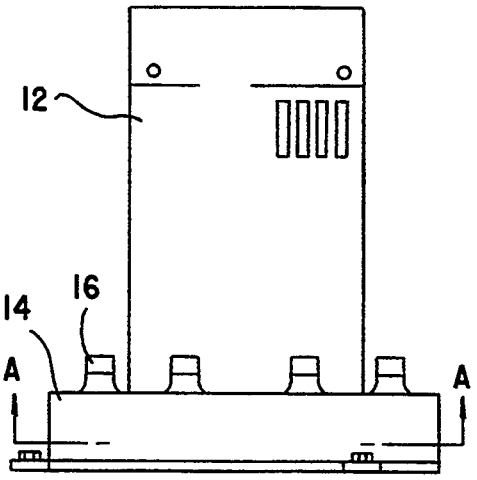
FIG. 2A is a side view of the motor of FIGS. 1A and 1B.
Figure 2B:
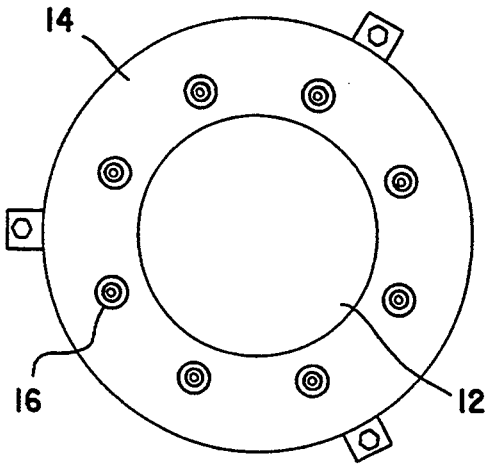
FIG. 2B is an elevational view of the motor of FIG. 2A.
Figure 2C:
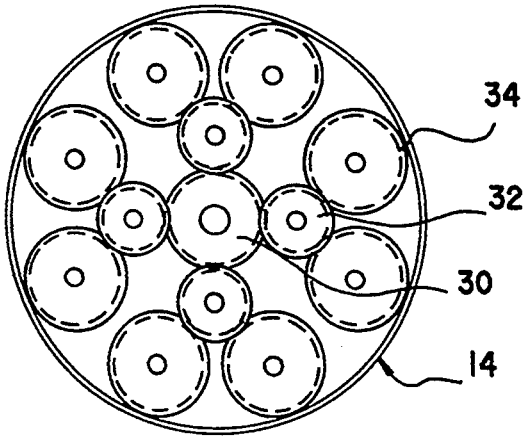
FIG. 2C is an cross-sectional elevational view of FIG. 2A along the lines A—A.

As depicted in FIGS. 2A, 2B, and 2C, the gearbox 14 has attached to the motor 12 one large gear 30 that drives smaller gears 32. The smaller gears 32 drive drive gears 34, which are attached to the drive outputs 16.

Figure 3:
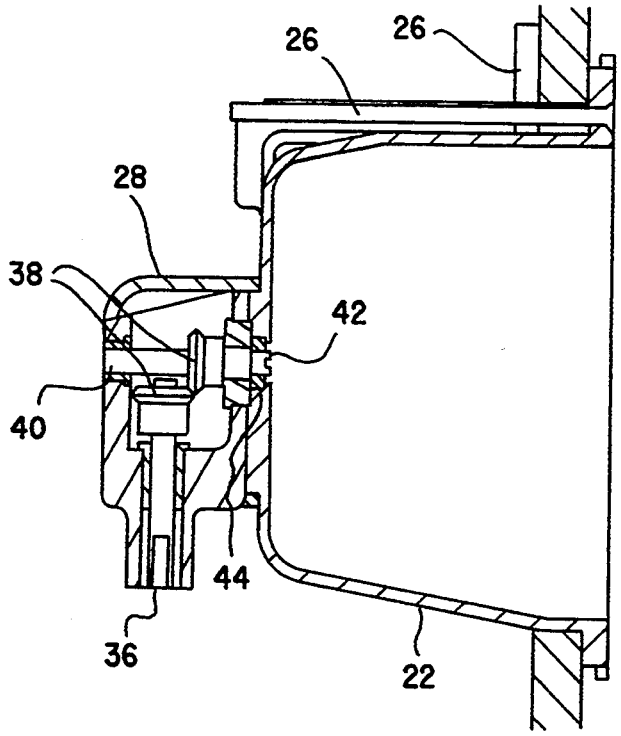
FIG. 3 is a side cross-sectional view of a jet casing and gear housing.

As depicted in FIG. 3, each of the gear housings 28 has an input drive 36. The input drive 36 is connected to a set of miter gears 38. The miter gears have a drive shaft 40 that penetrates the back of jet casing 22. The drive shaft 40 has a slotted drive 42. A seal 44 creates a water-proof seal between the jet casing 22 and the drive shaft 40. The seal 44 is of such character that a seal is maintained even when shaft 40 turns.

Figure 4A:
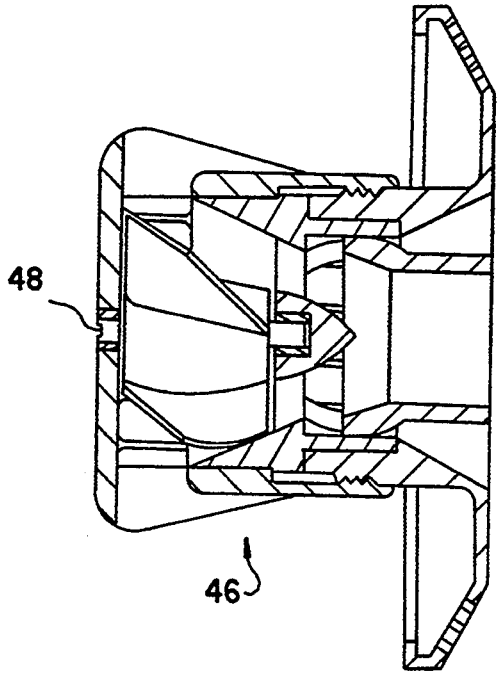
FIG. 4A is a side cross-sectional view of a jet apparatus.
Figure 4B:
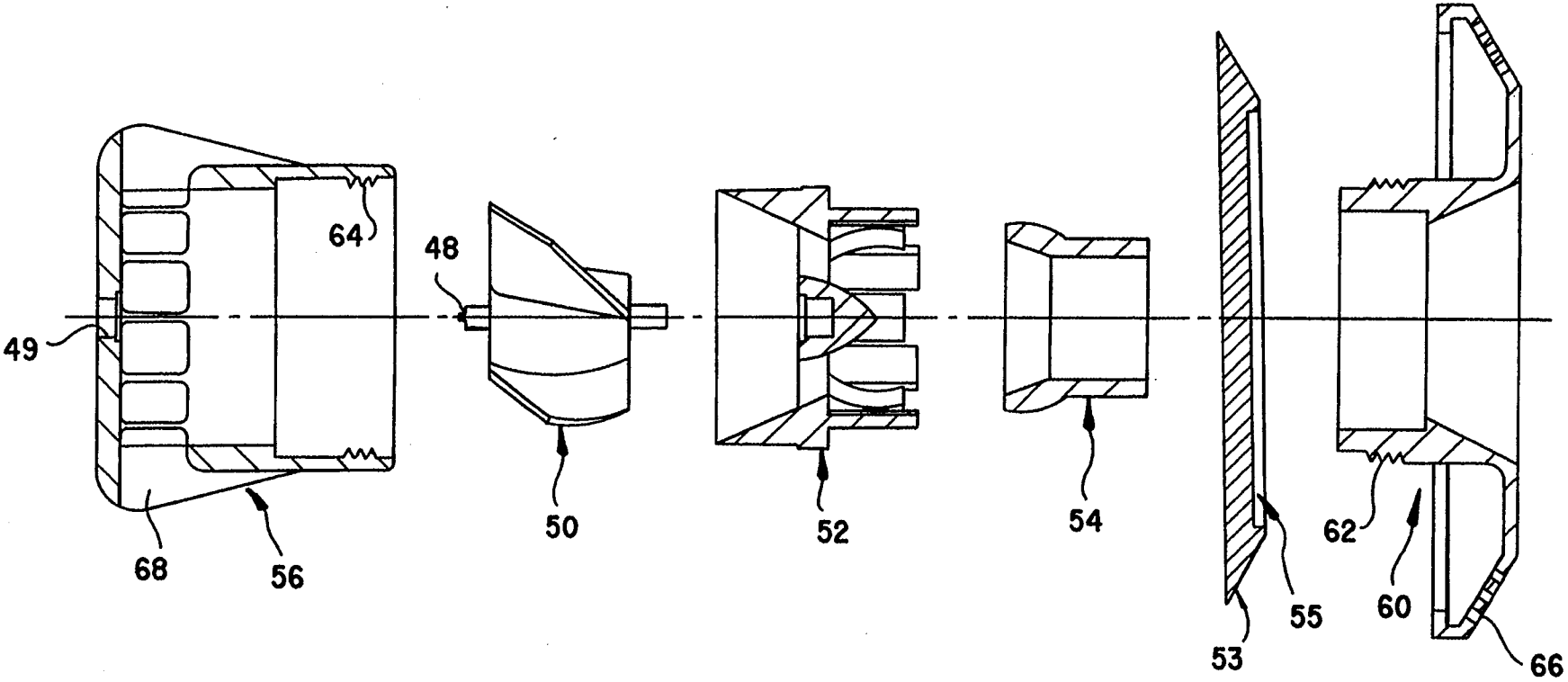
FIG. 4B is a side, cross-sectional, exploded view of the jet apparatus of FIG. 4A including a filter.

FIGS. 4A and 4B depict a jet assembly 46. The jet assembly 46 has an impeller shaft 48 mounted on an impeller 50. The impeller 50, collet 52, and jet nozzles 54 are mounted within intake stator 56 such that impeller shaft 48 extends through hole 49 in the back of the intake stator 56.

The jet assembly 46 is assembled by placing the impeller 50, collet 52, and jet nozzle 54 between the intake stator 56 and jet escutcheon 60 and rotating the jet escutcheon 60 so as to engage threads 62 and 64. The threads 62 and 64 so engaged, the impeller shaft 48 extends through a hole 49. The assembled jet assembly 46 is inserted into the jet casing 22 such that the impeller shaft 48 mates with the slotted drive 42. As particularly illustrated in FIGS. 5 and 6, the jet assembly 46 is locked into the jet casing 22 by rotating jet escutcheon 60 so that teeth 70 of the jet escutcheon 60 engage shoulders 72 of the jet casing 22.

As particularly illustrated in FIG. **4*b*, the jet assembly may include a preferred filter 53 having an opening 55. The filter 53 filters such matter as hair from the intake water at the holes 66, but allows jetted water to pass freely out of the jet assembly 46**.

In operation, the motor 12 turns the gear 30 of the gearbox 14. Through gears 32 and 34, gear 30 turns the drive outputs 16. The drive outputs 16 turn the flexible drive shafts 20, which turn the input drive 36, the miter gears 38, and the drive shaft 40. The drive shaft 40 turns the impeller 50. As the impeller 50 rotates, water is drawn from the bathtub 10 through holes 66 in the escutcheon 60. The water drawn through the holes 66 into intake 68 of the stator 56, where the impeller 50 forces the water through the collet 52, through the jet nozzles 54, and back into the bathtub 10. The direction of the water forced into the bathtub 10 can be redirected by adjusting the jet nozzle 54.

As is apparent from the drawings, the entire jet assembly 46 may be manually and easily removed, disassembled, cleaned on all wetted surfaces, reassembled, and replaced. In the preferred embodiment, as reflected in the drawings, the removal, disassembly, cleaning, assembly, and replacement can all be done quickly by hand, without tools or chemicals, and without substantial skill. Furthermore, the removal, disassembly, cleaning, reassembly, and replacement can be done without breaking necessary water proof seals. Thus, the jet apparatus can be cleaned, even with water in the whirlpool bathtub, without water damage or water leakage.

"Whirlpool bathtub" is intended to encompass all types of tubs, whirlpools, jacuzzies, and other containers in which it is necessary to circulate a fluid. "Jet Assembly" is intended to mean any fluid pumping apparatus having means for both receiving and pumping fluid without external tubing. "Port" means any location in the wall of a whirlpool bathtub for affixing a jet assembly.

The foregoing embodiment is the presently preferred embodiment of the claimed invention. It will be readily apparent to one skilled in the art that many variations of the invention can be made without deviating from the scope of the claims. For example, the casing of the preferred embodiment may be eliminated and the jet assembly may be modified to sealingly insert as a single water-proof assembly into a hole, a depression, or other suitable location within the bathtub. The gear housing may be substituted by any driving means that will drive the jet assembly. Air may be injected into the flow of water from the jet assembly by means of a high-pressure check valve or other suitable means capable of preventing fluid from backwashing into the air tubing, thereby making bubbles in the whirlpool bathtub. A heating element without external tubing may be added.

I claim:

1. A whirlpool jet apparatus comprising:

a jet casing adapted to be mounted in a tub aperture in a water tight manner, said casing providing an open end facing into a tub interior and a closed end;

a jet assembly being housed in said casing, said assembly being insertable and removable through said open end and said assembly being operably housed substantially within said casing by hand manipulatable means for retaining;

said jet assembly when housed and retained being engaged with means on said casing for driving said assembly to produce jetted water to be ejected through said open end.

2. The whirlpool jet apparatus according to claim 1, wherein said jet assembly comprises an external housing and internal means for receiving and pumping water.

3. The whirlpool jet apparatus according to claim 2, wherein said internal receiving and pumping means comprises:

a nozzle located within the external housing of the jet assembly for directing an axial discharge of water into the tub interior; and an impeller located behind the nozzle within the external housing of the jet assembly for generating an axial flow of water through the nozzle into the tub interior.

4. The whirlpool jet apparatus to claim 3, wherein said external housing of said jet assembly comprises an intake stator having a cavity for receiving said impeller and said nozzle, said intake stator removably coupled to a jet escutcheon having holes about an outer peripheral surface thereof for drawing water from the tub interior into the jet assembly.

5. The whirlpool jet apparatus according to claim 4, wherein said intake stator is removably coupled to said jet escutcheon by hand manipulatable means for securing.

6. The whirlpool jet apparatus according to claim 4, further comprising a filter located behind the holes of the jet escutcheon for preventing solid material from entering the jet assembly.

7. The whirlpool jet apparatus according to claim 1, wherein the said driving means engages the jet assembly through a hole in the closed end of the jet casing and sealingly and rotatably communicates with the hole.

8. The whirlpool jet apparatus according to claim 7, wherein said driving means is mechanical.

9. The whirlpool jet apparatus according to claim 8, wherein said mechanical driving means comprises a motor connected to the jet assembly by a flexible drive shaft.

10. The whirlpool jet apparatus according to claim 9, wherein a motor is connected to a plurality of jet assemblies by a corresponding plurality of flexible drive shafts.

11. The whirlpool jet apparatus according to claim 1, wherein said jet assembly is comprised of a plurality of components, said plurality of components being insertable and removable from said casing as a one-piece unit.

* * * * *